US005846106A

United States Patent [19]

Kumita

[11] Patent Number: 5,846,106

[45] Date of Patent: Dec. 8, 1998

[54] OUTBOARD MOTOR MOUNTING

[75] Inventor: Atsushi Kumita, Hamamatsu, Japan

[73] Assignee: Sanshin Kogyo Kabushiki Kaisha, Hamamatsu, Japan

[21] Appl. No.: 841,066

[22] Filed: Apr. 29, 1997

[30] Foreign Application Priority Data

Apr. 30, 1996 [JP] Japan ..... 8-109768

[51] Int. Cl.[6] ..... B63H 1/15

[52] U.S. Cl. ..... 440/52; 248/635; 248/638

[58] Field of Search ..... 440/52; 248/635, 248/638

[56] References Cited

U.S. PATENT DOCUMENTS 3,139,250 6/1964 Turlay ..... 248/635
3,934,537 1/1976 Hall ..... 440/52
4,471,935 9/1984 Chiba et al. ..... 248/638
5,149,284 9/1992 Kawai ..... 440/52
5,219,306 6/1993 Takahashi ..... 440/52
5,511,997 4/1996 Yoshida ..... 440/52

*Primary Examiner*—Sherman Basinger
*Attorney, Agent, or Firm*—Knobbe, Martens, Olson & Bear LLP

[57] ABSTRACT

A mounting arrangement for an outboard motor having a body which is connected to a watercraft mounting bracket by at least one mount is disclosed. The mount includes a resilient isolating member having a spring constant in a direction parallel to an axis extending from the front to the rear of the motor which is greater than its spring constant in direction parallel to a second line extending transverse to the first line. So arranged, the frequency of the excitation force applied to the isolating member over normal engine operating speeds does not correspond to the natural frequency of the isolating member in either direction, and resonant modes are avoided.

8 Claims, 6 Drawing Sheets

OUTBOARD MOTOR MOUNTING

FIELD OF THE INVENTION

The present invention relates to an outboard motor mounting, and more particularly, to a mounting which dampens vibrations.

BACKGROUND OF THE INVENTION

Conventional outboard motors include an internal combustion engine positioned within a cowling of the motor. The engine powers a drive shaft which extends vertically below the engine through a drive shaft housing of the engine to a transmission. The transmission transmits force from the drive shaft through a propeller shaft to a propeller.

The outboard motor is arranged to be movably connected to the transom of a watercraft. Typically, the drive shaft housing portion of the motor is connected to a steering shaft. The steering shaft is, in turn, journalled for rotation within a swivel bracket. The swivel bracket is connected to a clamping bracket which is connected to the watercraft.

It is desirable for the outboard motor to be isolated from the watercraft to dampen the driving thrust of the motor, torsional vibrations, and the like. In the prior art arrangement, as illustrated in FIG. 1, an upper mounting member 20 is utilized to isolate the drive shaft housing portion of the motor from the mounting portion of the motor, including the steering shaft. In this arrangement, a housing member 22 extends from a plate 24. The plate 24 has apertures through which the drive shaft and a shift linkage rod extend, and is connected to the drive shaft housing of the outboard motor with a number of bolts 26.

The plate 24 is connected to a handle bracket 30 member which extends from a steering shaft. A pair of bolts 28 extend through the housing member 22 to the handle bracket 30. The bolts 28 extend through sleeves 32, each bolt maintained in position with a nut 34.

While each bolt 28 is rigidly connected to the handle bracket 30 portion of the steering shaft, the bolts 28 are resiliently connected to the plate 24. Notably, a rubber bushing 36 encircles the sleeve 32 extending over each bolt 28 between the bolt 28 and the housing portion 22 of the plate 24.

The propulsion force is generally along an "X" axis, that being towards and away from the watercraft. While the mounting is arranged to transmit the propulsion force through the motor to the watercraft, the mounting is also arranged to isolate the watercraft from smaller propulsion force oscillations or vibrations.

A problem arises in this mounting arrangement, however. First, not all of the excitation forces are in the "X" direction. Some of the force are along a "Y" axis (that being generally transverse to the watercraft, or along the transom). For one, a crankshaft balance mechanism is often utilized which results in a transfer of forces into the "Y" direction.

In this case, each bushing 36 is subjected to a shearing force in the "X" direction and a compression force in the "Y" direction. As a result, the bushing is subjected to a coupled excitation force. The bushing has a spring constant which is generally small in the "X" direction and large in the "Y" direction. When the excitations along both axes act upon the bushing, the result is that the natural frequency of the bushing in the "Y" direction is equal or nearly equal to the frequency of the excitation force generated by the motor at one engine operating speed, and an amplification of the vibration results (i.e. a resonant mode is achieved with little damping to reduce the amplitude). This is illustrated in FIG. 2, which graphically illustrates the vibration level as compared to engine speed for the prior art mounting arrangement. For a particular prior art mounting, this graph indicates that at an engine speed of approximately 3500 rpm, the excitation vibration corresponds to the natural frequency, which when coupled with inadequate damping, results in an amplification of the vibration.

An outboard mounting arrangement which dampens outboard motor vibrations, and more specifically, a mounting arranged to prevent the occurrence of a resonant mode, is desired.

SUMMARY OF THE INVENTION

In accordance with the present invention, there is provided an outboard motor mounting for a motor having a body which houses an internal combustion engine and which has a mounting bracket for mounting the motor to a watercraft. When the motor is mounted to a hull of the craft, a first axis extends through the front and rear of the motor and generally in a forward and rear direction with respect to the watercraft. A second axis extends perpendicular to the first axis, through the sides of the motor and generally transverse to the hull of the watercraft.

The mounting comprises a mount which connects the body of the outboard motor and the bracket. The connector includes a resilient isolation member. The resilient isolation member is arranged to have natural frequencies in directions parallel to the first and second axis which fall outside the frequency range of the excitation forces over the normal engine operating range, whereby a resonant mode is prevented. In the preferred arrangement, this is accomplished by having the resilient isolation member have a spring constant which is larger in the direction along the first axis than a spring constant in the direction along the second axis.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, an improved outboard motor mounting arrangement is provided. In general, the mounting arrangement is designed to dampen vibrations at all engine operating speeds, and is arranged to prevent a resonant mode from occurring.

Figure 1:
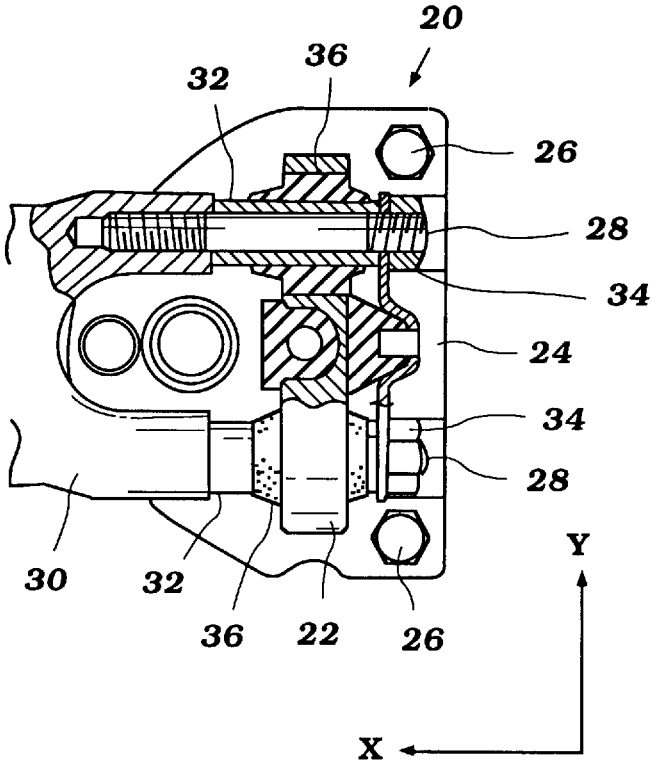
Figure 1 (Prior Art)
FIG. 1 is a cross-sectional view of a prior art outboard motor mounting arrangement.
Figure 2:
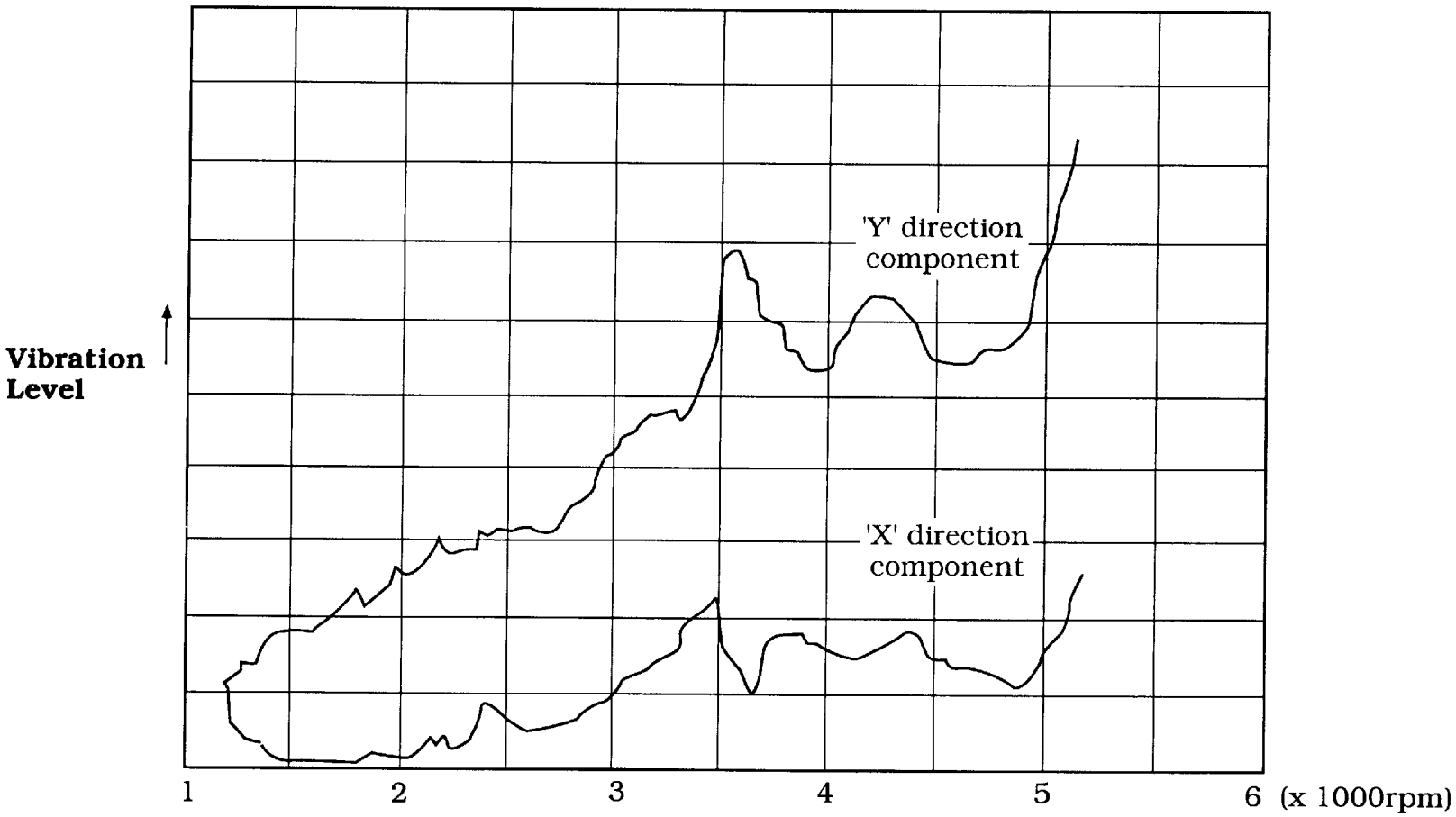
Figure 2 (Prior Art)
FIG. 2 is a graph illustrating vibration level versus engine speed for the prior art motor mounting illustrated in FIG. 1.
Figure 3:
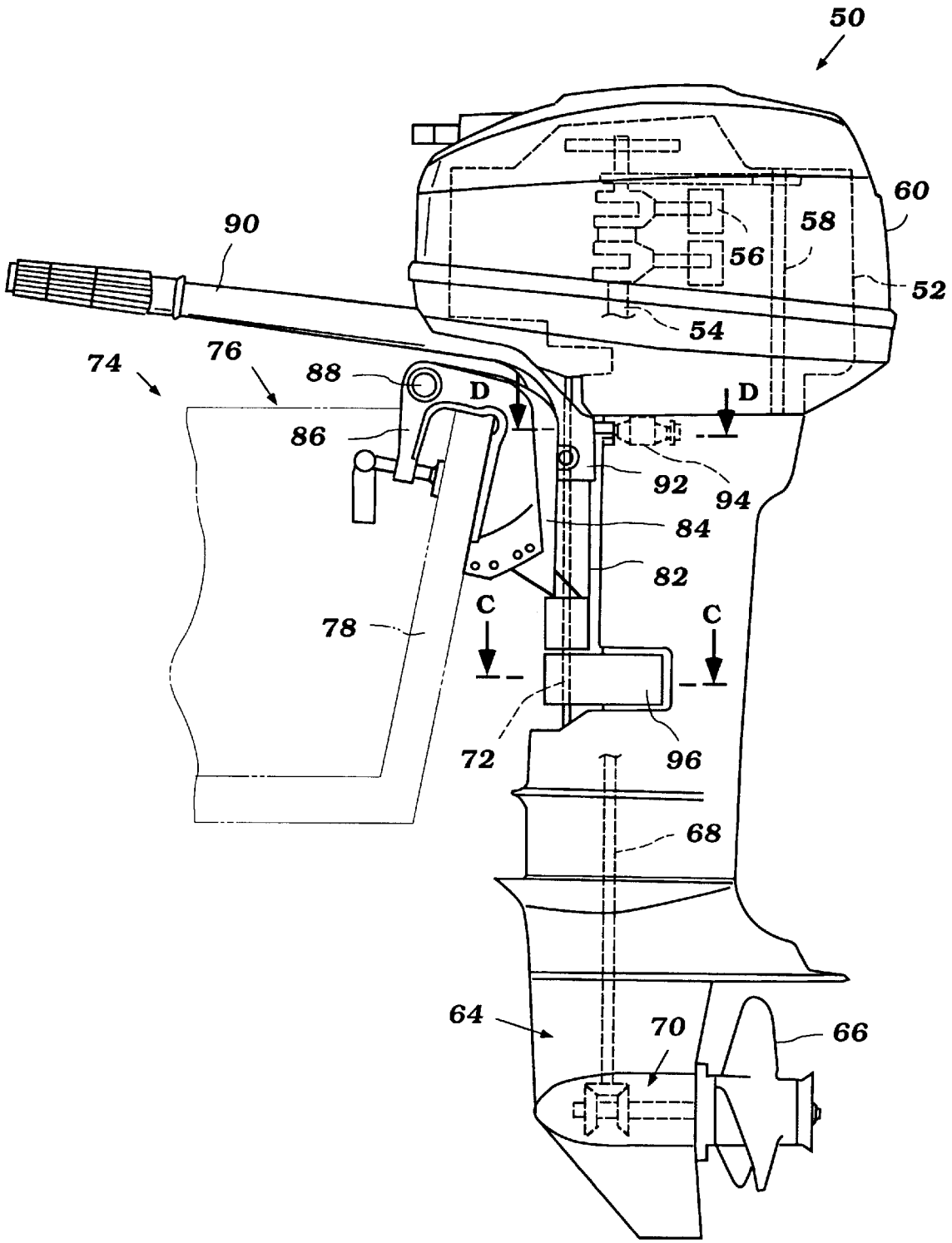
FIG. 3 is a side view illustrating an outboard motor mounted to a watercraft, the outboard motor having a mounting arrangement in accordance with the present invention.

As illustrated in FIG. 1, an outboard motor 50 has a water propulsion device powered by an internal combustion engine 52. The engine 52 is preferably of the four-cycle variety, and arranged so that a crankshaft 54 thereof is arranged vertically. In this arrangement, each piston 56 of the engine 52 reciprocates in a generally horizontal plane. Each piston 56 is connected to the crankshaft 54 for driving the crankshaft in rotating fashion.

Each piston 56 reciprocates in a cylinder having a combustion chamber portion. Preferably, at least one intake valve (not shown) and at least one exhaust valve (not shown) are provided for controlling the flow of air into each combustion chamber through an intake passage and for controlling the flow of exhaust from each combustion chamber through an exhaust passage. At least one camshaft 58, which is preferably driven by the crankshaft 54, actuates the at least one intake and exhaust valve.

It should be understood that the particular engine which is utilized to power the motor 50 may be of variety of types and configurations, as known to those skilled in the art. These engines include, but are not limited to engines operating on a two-cycle engine and those arranged in "V", flat and opposing fashion. Further, the engine 52 may include as few as one combustion chamber or more than one. The engine 52 may be further arranged so as to have other than a piston slidably mounted in the combustion chamber, such as in the case of a rotary engine.

The outboard motor 50 has a body which includes a cowling portion 60. As illustrated, the engine 52 is positioned within the cowling portion 60. In addition, the body of the motor 50 includes a drive shaft housing 62 which extends below the cowling 60. A water propulsion device 64 is positioned at the bottom end of the outboard motor 50. Preferably, the propulsion device 64 is a propeller 66 rotatably connected to the motor 50.

The crankshaft 54 of the engine 52 is connected in driving relation to a drive shaft 68. The drive shaft 68 extends from its connection with the crankshaft 54 through the drive shaft housing 62 to a suitable transmission 70 which may include forward, reverse and neutral positions. The transmission 70 is controlled remotely by a shift linkage rod 72. The transmission 70 selectively transmits the drive shaft 68 force to the propeller 66.

As illustrated, the outboard motor 50 is utilized to propel a watercraft 74 having a hull 76. The outboard motor 50 is connected to a transom 78 of the hull 76.

The body of the motor 50 is connected to a watercraft mounting structure or bracket for connecting the motor 50 to a watercraft. This bracket preferably includes a steering shaft 80 (see FIG. 6) rotatably positioned within a steering pipe 82 which is connected to a swivel bracket 84. The positioning of the steering shaft 80 in the steering pipe 82 permits rotation of the motor 50 for steering of the watercraft 74.

The swivel bracket 84 is pivotally connected to a clamping bracket 86 by means of a tilt pin 88. This mounting allows the motor 50 to be tilted up and down about the horizontal axis along which the pin 88 is positioned, for trimming the motor, as is well known in the art.

Steering is preferably effectuated by a steering handle 90. A handle bracket 92 is connected to a top end of the steering shaft 80. The handle 90 extends from the handle bracket 92 towards the watercraft 50. In the embodiment illustrated, steering is manual, that is to say that it is solely through force applied by the operator to the handle 90 that the motor 50 moves. The steering may be power assisted, however, or by way of a steering wheel or other remote steering mechanism.

As described above, the transmission 70 is preferably operated by a shift linkage rod 72. Preferably, the shift rod 72 extends from the transmission 70 through a hollow center of the steering shaft 80 and through the handle bracket 92, before connecting to a shift linkage. The shift linkage may be a control, or a link leading to a control, by which the operator of the watercraft 74 may selectively shift the transmission 70.

In the particular mounting arrangement of the present invention, an upper mount 94 connects the drive shaft housing 62 of the body of motor 50 to the handle bracket 92 extending from the steering shaft 80. A lower mount 96 preferably connects the drive shaft housing 62 of the motor 50 with the steering shaft 80.

Figure 4:
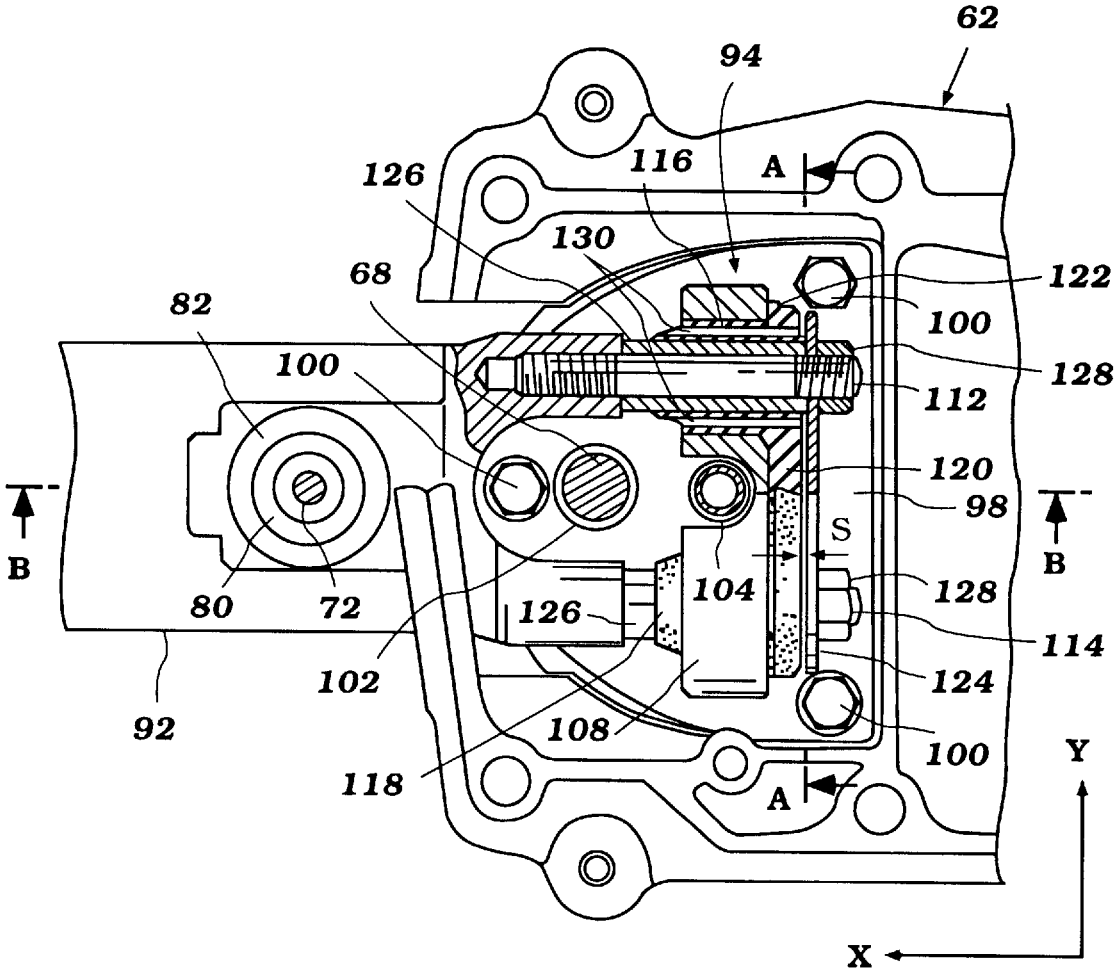
FIG. 4 is a cross-sectional view of an upper mounting of the motor illustrated in FIG. 3, taken along line D—D therein.
Figure 5:
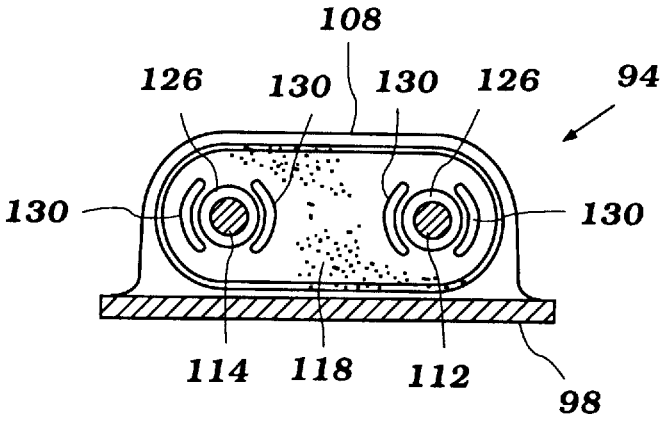
FIG. 5 is a cross-sectional view of the upper mounting of the motor illustrated in FIG. 4, taken along line A—A therein.
Figure 7:
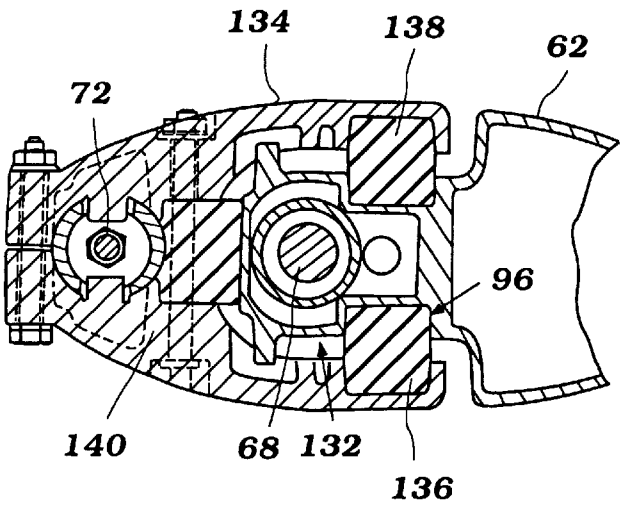
FIG. 7 is a cross-sectional top view of a lower mounting of the motor illustrated in FIG. 3, taken along line C—C therein.
Figure 6:
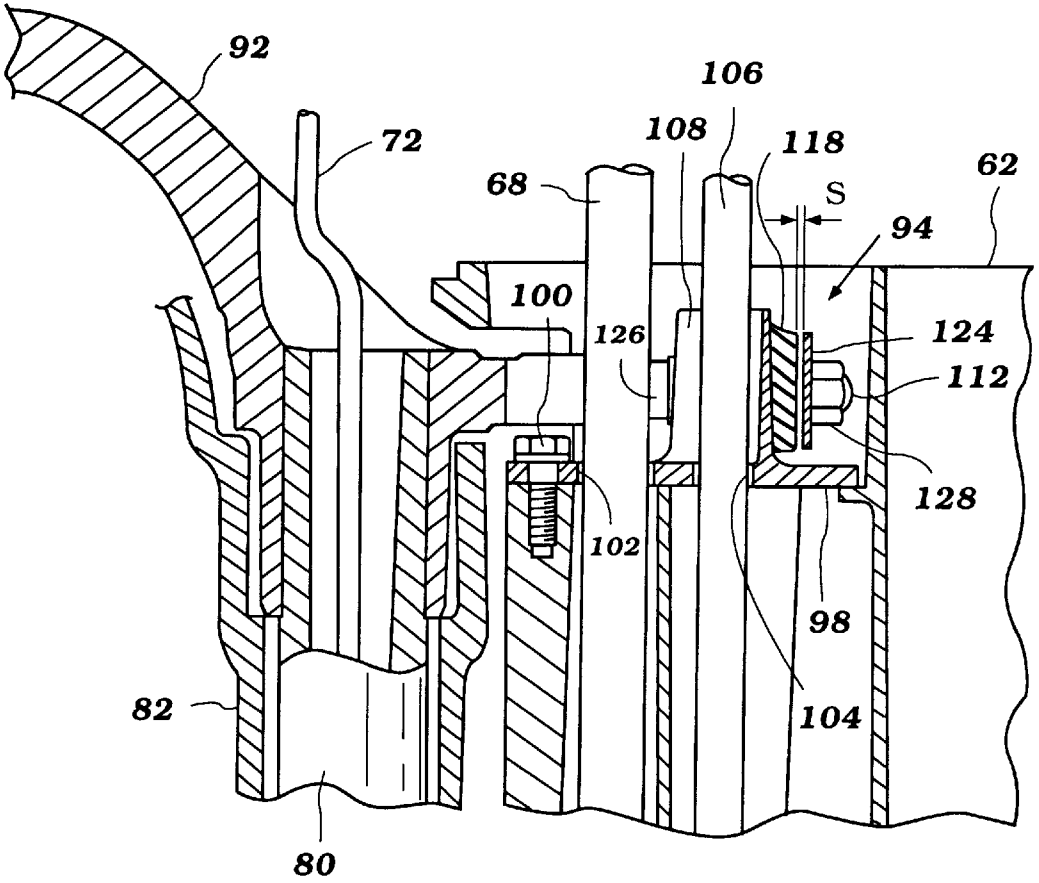
FIG. 6 is a cross-sectional side view of the upper mounting illustrated in FIG. 3, taken along line B—B therein.

The upper mount 94 is best illustrated in FIGS. 4–6. As illustrated therein, the mount 94 is arranged to vibration isolate the main portion of the motor 50 (including the cowling 60 and drive shaft housing 62 and members therein) from the motor's connection to the watercraft 74. More particularly, the upper mounting 94 is arranged such that a spring constant in a "X" direction (i.e. in a direction along a length of the hull of the watercraft, from a front to a rear of the motor, or toward and away from the watercraft 74) is larger than a spring constant in a "Y" direction (i.e. in a direction transverse to the watercraft through the sides of the motor, or generally parallel to the width of the transom 78), whereby the mounting has a natural frequency in the "X" and "Y" directions which falls outside the range of frequencies of the excitation forces applied thereto over normal engine operating ranges (which may vary from engine to engine). Since the natural and excitation frequencies do not ever correspond, resonant modes are avoided and the mounting is effective in transmitting only low amplitude vibrations.

In the preferred arrangement, a base or mounting plate 98 is connected to the drive shaft housing 62 within the housing by a number of bolts 100. As best illustrated in FIGS. 4 and 6, the base 98 has a first aperture 102 for accommodating the passage of the drive shaft 68 therethrough. In addition, the base 98 has a second aperture 104 for accommodating the passage of a cooling water supply pipe 106 therethrough.

A housing member 108 extends upwardly from the base 98 in a generally vertical direction. The housing member 108 is positioned approximately midway between a front edge and a rear edge of the base 98. In the arrangement illustrated, the position of housing member 108 requires a vertically arranged groove 110 (see FIG. 4) accommodating the pipe 106.

The base 98 is connected to the handle bracket 92 via the housing member 108. This connection includes at least one connector extending from the handle bracket 92. Preferably, this at least one connector comprises first and second bolts 112,114.

The housing member 108 includes a pair of spaced, generally horizontally (i.e. parallel to the plane in which the base 98 is positioned) passages 116. Each bolt 112,114 has a first end which threadingly engages the handle bracket 92. The bolts 112,114 extend outwardly from the bracket 92 in a direction opposite the watercraft 74. The bolts 112,114 each extend through one of the passages 116 through the housing member 108.

The upper mount 62 includes resilient isolation means. This means supports the portion of the bolts 112,114 which pass through the housing member 108 and isolates the body of the motor 50 from the watercraft to which the motor 50 is mounted. Preferably, this means comprises one or more elastic members. More preferably, the means is a rubber or similar elastomeric bushing 118. The bushing 118 has a first section positioned within one of the passages 116 through the housing member 108, and a second section positioned within the other passage 116 through the housing member. The two sections of the bushing 118 are connected by a connecting portion 120.

The first and second sections of the bushing 118 positioned within the passages 116 have a generally horizontally extending bore through which the first and second bolts 112,114 pass, respectively. Preferably, the bushing 118 includes a flange section 122 for abutting the housing member 108. This flange section 122, along with the connecting section 120, prevents the bushing 118 from moving in a direction towards the watercraft 74.

A stop plate 124 is positioned on the side of the bushing 118 opposite the watercraft 74. For reasons described in more detail below, this plate 124 is spaced by a distance "S" (see FIG. 6) in the "X" direction from the bushing 118. This is preferably accomplished by positioning a sleeve 126 over each bolt 112,114. Each sleeve 126 has a first end which abuts the handle bracket 92 adjacent the connection of the bolt 112,114 thereto. Each sleeve 126 extends over its respective bolt 112,114 to a second end which is positioned beyond the end of the bushing 118 opposite the watercraft 74. The stop plate 124 abuts the second end of each sleeve 126. Because each sleeve 126 extends slightly beyond the bushing 118, the stop plate 124 is spaced slightly from the bushing 118.

The second end of each bolt 112,114 extends beyond its respective sleeve 126 and through an aperture in the stop plate 124. The second end of each bolt 112,114 is threaded for acceptance of a nut 128. The nut 128 prevents undesired removal of the plate 124 and thus prevents the bushing 118 from dislodging from the housing member 108.

As stated above, the bushing 118 is arranged so that is spring constant in the "X" direction is larger than its spring constant in the "Y" direction. That is to say, the spring constant in a direction toward and away from the watercraft 74 is larger than the constant in a direction transverse to the craft 74. As one aspect of this arrangement, arcuate slots 130 are positioned in the bushing 118 in each section surrounding the bolts 112,114, as illustrated in FIG. 5. Each slot 130 extends a portion of the way around the bolt 112, 114. Preferably, the slots 130 do not extend through the bushing 118 above and below the bolts 112,114, but only along the inside and outside of the bolts. The bushing 118 may have a number of material variations for also effectuating this difference in spring constant.

Figure 8:
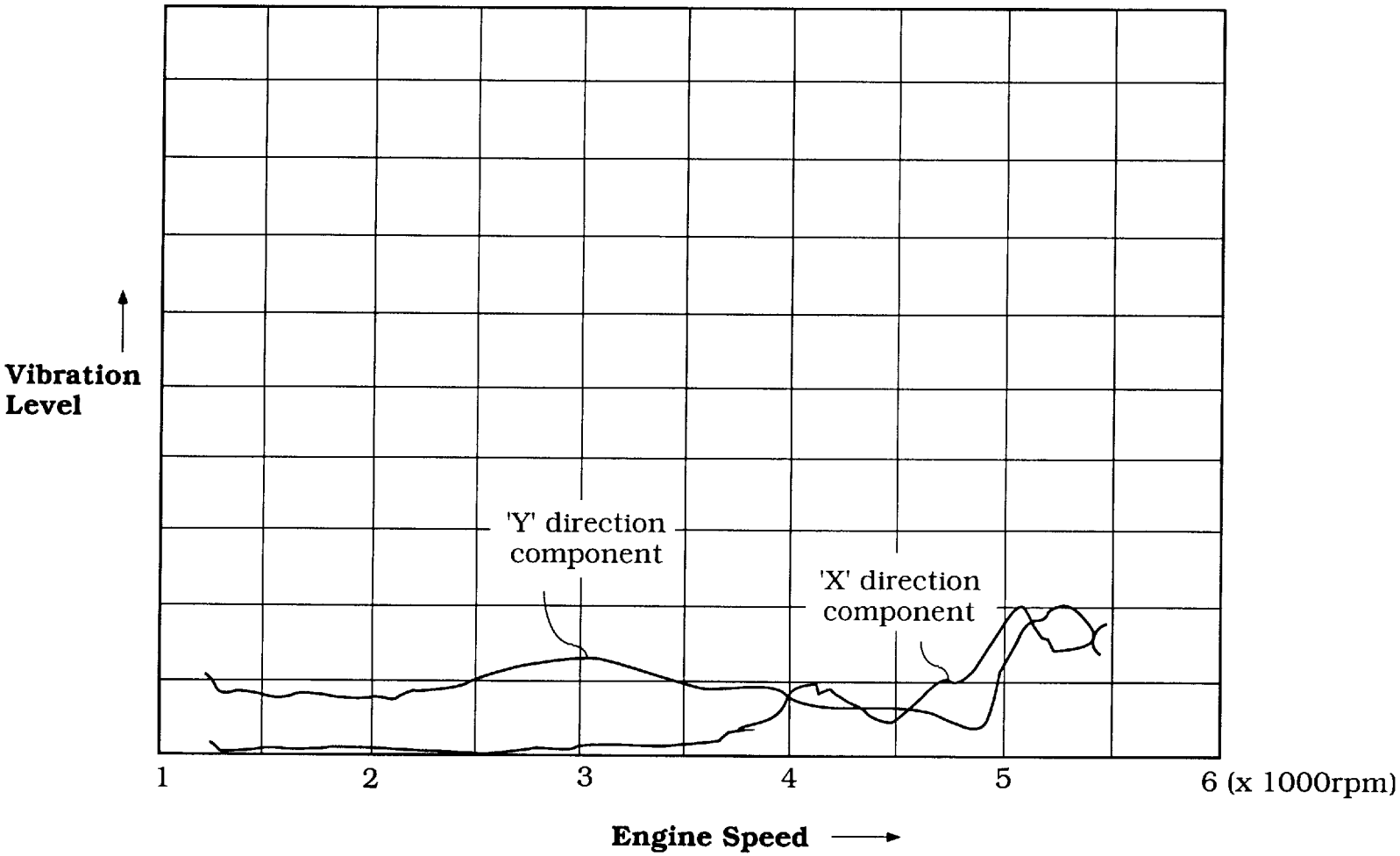
FIG. 8 is a graph illustrating vibration level verses engine speed for the mounting in accordance with the present invention.

In the preferred embodiment, the effective spring constant for the bushing 118 is approximately 34 Kg/mm or more in the "X" direction, and approximately 13 Kg/mm in the "Y" direction. When the spring constants are so provided and the excitation forces in the "X" and "Y" directions are applied, the spring constants cause the bushing 118 to have a natural frequency which does not generally lie within the range of vibration frequencies generated by the engine 22 over its operating rpm. Since the excitation frequency does not ever match the natural frequency of the bushings in either direction, a resonant mode is prevented, and the amplitude of the vibrations transmitted through the mounting are kept low, as illustrated in FIG. 8.

While the bolts 112,114 have been described as connected to the handle bracket 92 in a threading manner, the bolts 112,114 may be securely attached in any manner known to those skilled in the art, including welding or the like. In addition, the bolts 112,114 actually may comprise posts extending from the handle bracket 92, as formed integrally therewith.

The lower mount 96 is also arranged to provide a vibration isolating or dampening function. As illustrated, the drive shaft housing 62 has an outwardly extending portion 132 which houses the drive shaft 68. This portion 132 is positioned within a housing 134 which is positioned at the bottom end of the steering shaft 80.

The outwardly extending portion 132 of the drive shaft housing 62 is isolated from the housing 134 by at least one elastic member. Preferably, three rubber mounts 136,138, 140 are positioned between the portion 132 and housing 134. A first and second mounts 136,138 are positioned on opposite sides of the outwardly extending portion 132 and the housing 134. The third mount 140 is positioned at an end of the portion 132 which faces the watercraft 74.

A variety of lower mount configurations are possible, as known to those skilled in the art.

In accordance with the present invention, varying spring constants are utilized to ensure no resonant modes occur, it being generally known that the spring constant affects the natural frequency of the resilient member. While this is the preferred arrangement, other means known in the art for controlling the natural frequency to cause it to be outside of the range of excitation force frequencies may be utilized.

Of course, the foregoing description is that of preferred embodiments of the invention, and various changes and modifications may be made without departing from the spirit and scope of the invention, as defined by the appended claims.

What is claimed is:

1. A mounting arrangement for an outboard motor having a body and a watercraft mounting bracket, said outboard motor body housing an internal combustion engine therein, said internal combustion engine arranged to drive a water propulsion device of the motor, said body of said motor connected to said bracket with a mount, said bracket adapted to connect said motor to a hull of a watercraft, said hull having a length and a width, said motor having a first axis passing therethrough and extending generally parallel to said length of said hull, and a second axis extending therethrough generally perpendicular to said first axis, said bracket having a first bolt and a second bolt extending therefrom towards said motor parallel to said first axis, said first and second bolts spaced from one another in a direction parallel to said second axis, said mount including a housing member extending around at least a portion of said first and second bolts, said mount also including at least one resilient mounting element isolating the bracket from said body of said motor, said at least one resilient mounting element positioned around at least a portion of said first and second bolts within said housing member, at least one slot extending through said at least one resilient mounting element in a portion of said resilient mounting element positioned between said housing and said first bolt and said second bolt, said at least one slot extending parallel to said first axis, said resilient mounting element having a spring constant in a direction along said first axis which is greater than a spring constant in a direction along said second axis.

2. The mounting arrangement in accordance with claim 1, wherein a slot is positioned in said at least one resilient mounting element on opposing sides of said first bolt and said second bolt.

3. The mounting arrangement in accordance with claim 1, wherein a sleeve extends about said first and second bolts, said sleeve abutting a stop plate and spacing said at least one resilient mounting element from said stop plate.

4. The mounting arrangement in accordance with claim 1, wherein said at least one resilient mounting element comprises a rubber bushing.

5. The mounting arrangement in accordance with claim 1, wherein a first vertically extending passage is provided through said mount through which a water pipe of said motor passes.

6. The mounting arrangement in accordance with claim 5, wherein a second vertically extending passage is provided through said mount through which a drive shaft extends.

7. The mounting arrangement in accordance with claim 1, wherein said slot is curved when viewed in a vertical plane extending parallel to said second axis.

8. The mounting arrangement in accordance with claim 1, wherein said at least one resilient mounting element comprises a bushing, said bushing having a first portion extending between said housing member and said first bolt, a second portion extending between said housing member and second bolt, and a connecting portion positioned outside of said housing member extending between said bolts.

* * * * *